US006635170B2

(12) United States Patent
Ravella

(10) Patent No.: US 6,635,170 B2
(45) Date of Patent: Oct. 21, 2003

(54) HYDROPROCESSING PROCESS WITH INTEGRATED INTERSTAGE STRIPPING

(75) Inventor: Alberto Ravella, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/957,939

(22) Filed: Sep. 21, 2001

(65) Prior Publication Data

US 2002/0074261 A1 Jun. 20, 2002

Related U.S. Application Data

(60) Provisional application No. 60/255,661, filed on Dec. 14, 2000.

(51) Int. Cl.[7] ..... C10G 45/00

(52) U.S. Cl. ..... 208/210; 208/58; 208/59; 208/60; 208/254.11; 208/264

(58) Field of Search ..... 208/210, 58, 59, 208/60, 254 H, 264

(56) References Cited

U.S. PATENT DOCUMENTS

| | | | | | |
|---|---|---|---|---|---|
| 3,367,660 | A | * | 2/1968 | Barnes | 208/15 |
| 3,663,434 | A | | 5/1972 | Bridge | 208/210 |
| 3,717,571 | A | | 2/1973 | Schulman | 208/254 |
| 3,968,031 | A | | 7/1976 | Frayer et al. | 208/210 |
| 4,116,816 | A | | 9/1978 | Davis et al. | 208/209 |
| 4,170,545 | A | | 10/1979 | Frayer et al. | 208/210 |
| 4,170,546 | A | | 10/1979 | Frayer et al. | 208/210 |
| 4,173,528 | A | | 11/1979 | Frayer et al. | 208/210 |
| 4,243,519 | A | * | 1/1981 | Schorfheide | 208/210 |
| 4,392,945 | A | | 7/1983 | Howard et al. | 208/210 |
| 4,399,026 | A | * | 8/1983 | Shiroto et al. | 208/216 PP |
| 5,110,444 | A | * | 5/1992 | Haun et al. | 208/89 |
| 5,143,595 | A | | 9/1992 | Thomas et al. | 208/58 |
| 5,282,958 | A | | 2/1994 | Santilli et al. | 208/111 |
| 5,358,627 | A | | 10/1994 | Mears et al. | 208/59 |
| 5,565,088 | A | | 10/1996 | Nair et al. | 208/58 |
| 5,611,912 | A | | 3/1997 | Han et al. | 208/58 |
| 5,705,052 | A | * | 1/1998 | Gupta | 208/57 |
| 5,720,872 | A | * | 2/1998 | Gupta | 208/57 |
| 5,851,381 | A | | 12/1998 | Tanaka et al. | 208/210 |
| 5,885,440 | A | | 3/1999 | Hoehn et al. | 208/97 |
| 5,904,835 | A | | 5/1999 | Thakkar | 208/78 |
| 5,968,346 | A | | 10/1999 | Jung et al. | 208/210 |
| 5,968,347 | A | | 10/1999 | Kolodziej et al. | 208/213 |
| 6,106,694 | A | | 8/2000 | Kalnes et al. | 208/57 |
| 6,190,535 | B1 | * | 2/2001 | Kalnes et al. | 208/89 |

* cited by examiner

*Primary Examiner*—Nadine G. Norton
(74) *Attorney, Agent, or Firm*—Jeremy J. Kliebert

(57) ABSTRACT

This invention relates to a two stage hydroprocessing process with stripping zones between the hydroprocessing zones and following the last hydroprocessing zone. The stripping occurs at high pressure and temperature with no disengagement between or following the hydroprocessing zones. There is recycle of high temperature gaseous effluent from the last stripping zone to the first stripping zone.

16 Claims, 1 Drawing Sheet

FIGURE
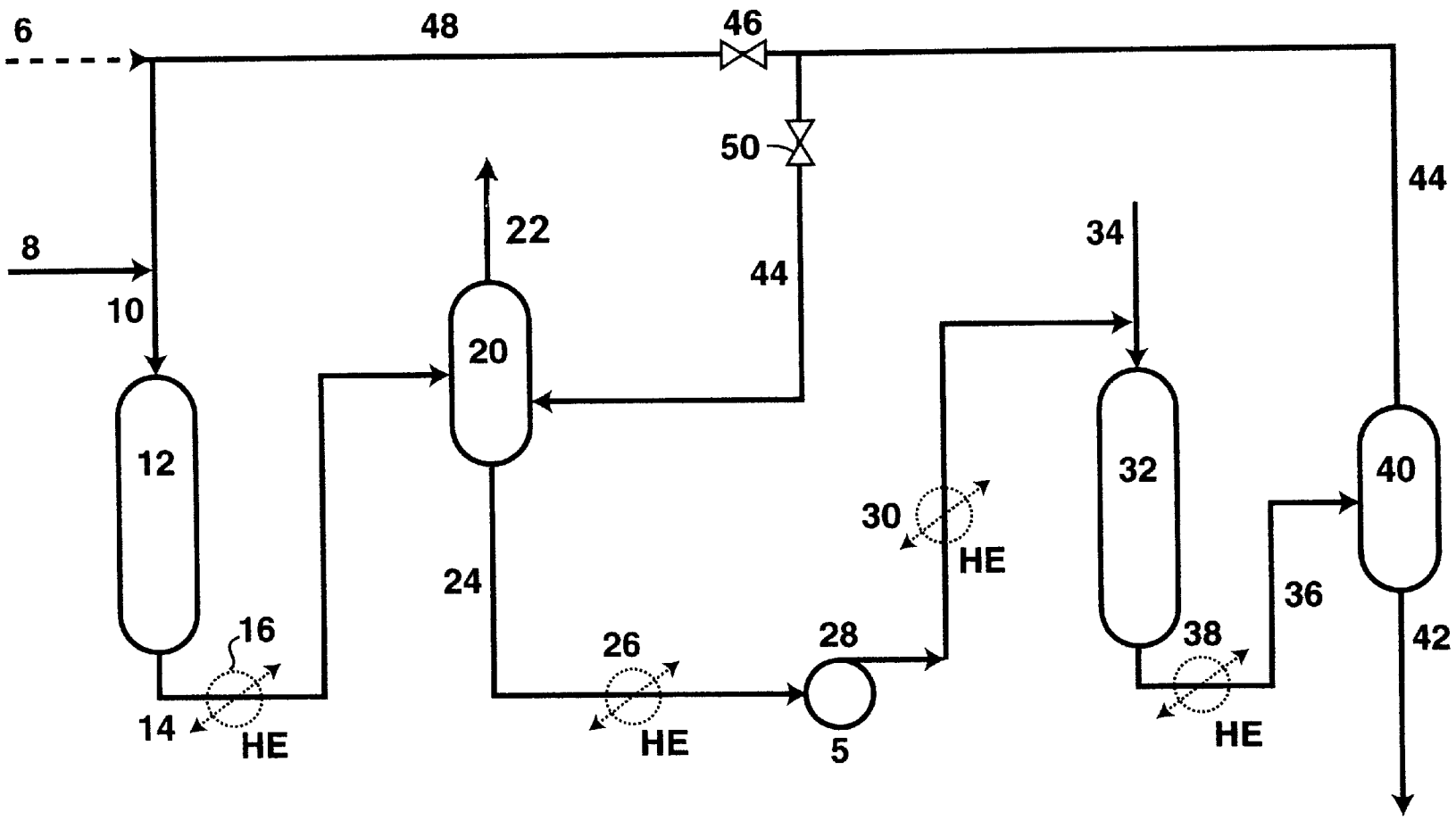

HYDROPROCESSING PROCESS WITH INTEGRATED INTERSTAGE STRIPPING

CROSS-REFERENCE TO RELATED APPLICATION

This application claims benefit of U.S. provisional patent application serial No. 60/255,661 filed Dec. 14, 2000.

FIELD OF THE INVENTION

This invention relates to a two stage hydroprocessing process with interstage stripping. More particularly, the interstage stripping occurs at high pressure and temperature with recycle of high temperature gaseous effluent from the stripping stage.

BACKGROUND OF THE INVENTION

A common method to remove contaminants such as nitrogen and sulfur from a hydrocarbon feedstock is to use a hydrotreating step to convert the nitrogen and sulfur contaminants to hydrogen sulfide and ammonia followed by stripping to separate the gaseous effluent from the liquids. The stripping is typically conducted at low temperature and pressure. The hydrotreating step is frequently followed by a further hydroprocessing step containing a catalyst which is sensitive to the presence of sulfur and nitrogen contaminants.

Stripping steps involve considerable investment and operating costs as stripping usually involves depressurization and cooling followed by pumping and heating to repressurize and reheat the feed to the next hydroprocessing step.

It would be desirable to have an interstage stripping process which minimizes the investment and operating costs associated with stripping.

SUMMARY OF THE INVENTION

This invention relates to an interstage stripping process which reduces the investment and operating costs associated with stripping. Accordingly there is provided a continuous process for interstage stripping between two hydroprocessing zones which comprises:

a. passing a hydrocarbon feedstock to a first hydroprocessing zone and hydroprocessing the feedstock under first hydroprocessing conditions to form a first hydroprocessed product, said first hydroprocessing zone having a first hydroprocessing temperature and pressure;

b. passing the first hydroprocessed product to a first stripping zone;

c. stripping the first hydroprocessed product to form a first gaseous and liquid effluent;

d. passing the liquid effluent from the first stripping zone to a second hydroprocessing zone and hydroprocessing the liquid effluent under second hydroprocessing conditions to form a second hydroprocessed product, said second hydroprocessing zone having a second hydroprocessing temperature and pressure;

e. passing the second hydroprocessed product to a second stripping zone;

f. stripping the second hydroprocessed product to form a second gaseous and liquid effluent; and g. passing at least a portion of the second gaseous effluent to the first stripping zone and contacting said second gaseous effluent with the first liquid effluent.

Another embodiment relates to a continuous process for interstage stripping between two hydroprocessing zones which comprises:

a. passing a hydrocarbon feedstock to a first hydroprocessing zone and hydroprocessing the feedstock under first hydroprocessing conditions to form a first hydroprocessed product, said first hydroprocessing zone having a first hydroprocessing temperature and pressure;

b. passing the first hydroprocessed product to a first stripping zone, said first stripping zone including a flash separator and a pressure stripper;

c. flashing the first hydroprocessed product to form a first gaseous and liquid effluent;

d. passing the first liquid effluent from the flash separator to the pressure stripper and stripping the liquid effluent to form a second gaseous and liquid effluent;

e. passing the second liquid effluent from the first stripping zone to a second hydroprocessing zone and hydroprocessing the liquid effluent under second hydroprocessing conditions to form a second hydroprocessed product, said second hydroprocessing zone having a second hydroprocessing temperature and pressure;

f. passing the second hydroprocessed product to a second stripping zone;

g. stripping the second hydroprocessed product to form a third gaseous and liquid effluent; and h. passing at least a portion of the third gaseous effluent to the first stripping zone and contacting said third gaseous effluent with the second liquid effluent.

The present process describes a method for removing nitrogen- and sulfur-containing contaminants from multi-zone hydroprocessing schemes without the need for disengagement, i.e., low-pressure stripping which involves depressurization, stripping and re-pressurization, and the attendant costs for such an operation.

BRIEF DESCRIPTION OF THE DRAWING

The FIGURE is a schematic drawing illustrating a hydroprocessing scheme without disengagement.

DETAILED DESCRIPTION

Feeds for hydroprocessing include whole and reduced crudes and fractions thereof. Examples include distillates such as atmospheric and vacuum gas oils, and coker gas oils, hydrocrackates, raffinates, extracts, hydrotreated oils, atmospheric and vacuum resids, deasphalted oils, dewaxed oils, slack waxes, Fischer-Tropsch waxes and mixtures thereof.

Hydroprocessing is used herein to denote various processes involving treatment of a feed in the presence of hydrogen and include processes which involve at least one of boiling range reduction, removal of contaminants, viscosity reduction, viscosity index (VI) increase, pour point reduction and aromatics saturation. Examples of typical hydroprocessing schemes include hydrotreating, hydrocracking, hydrofinishing, hydrodewaxing, hydrofining, hydroisomerization and raffinate hydroconversion. Such hydroprocessing schemes are well known in the art and are described in standard reference works such as "Petroleum Refining" by James H. Gary and Glenn E. Handwerk, Third Edition, Marcel Dekker, New York.

The primary purpose of hydrotreating is typically to reduce the sulfur, nitrogen, and aromatic content of a feed, and is not primarily concerned with boiling point conversion of the feed. Catalysts usually contain at least one of Group VIA and Group VIII metal on a less acidic support such as alumina or silica. Examples include Ni/Mo, Co/Mo and Ni/W catalysts. Hydrotreating conditions typically include temperatures of 315–425° C., pressures of 300–3000 psig, Liquid Hourly Space Velocities (LHSV) of 0.2–10 $h^{-1}$ and hydrogen treat rates of 500–10000 scf/bbl.

Hydrocracking involves at least some conversion of the boiling range of the feed to lower boiling products. Hydrocracking catalysts are generally more acidic than hydrotreating catalysts and include Group VIA and Group VIII metals on supports such as alumina, especially fluorided alumina, silica-alumina and zeolites. Examples include Group VIA and/or Group VIII metal, e.g., Ni/Mo on silica-alumina, Group VIA and/or Group VIII metal on zeolite, e.g., Ni/Mo on zeolites such as X or Y, Pd on zeolite and Ni/W on zeolite. Hydrocracking conditions include temperatures of 260–480° C., pressures of 800–3000 psig, LHSV of 0.1–10 $h^{-1}$ and treat gas rates of 1000–10000 scf/bbl.

Hydrofinishing is usually concerned with product quality issues such as daylight stability, color, haze, heteroatom removal, aromatics and olefin saturation and the like. Catalysts can be those used in hydrotreating including, e.g., Ni/Mo, Ni/W or Pd and/or Pt on a support such as alumina. Hydrofinishing conditions include temperatures of 200–350° C., pressures of 100–3000psig, LHSV of 0.1–5 $h^{-1}$ and treat gas rates of 100–5000 scf/bbl.

Hydrodewaxing relates to the removal of long chain, paraffinic molecules from feeds. Hydrodewaxing can be accomplished by selective hydrocracking or by hydroisomerizing these long chain molecules. Hydrodewaxing catalysts are suitably molecular sieves such as crystalline aluminosilicates (zeolites) or silico-aluminophosphates (SAPOs), preferably 10-ring sieves such as ZSM-5, ZSM-22, ZSM-23, ZSM-35, ZSM-48, SAPO-11, SAPO-41 and the like. These catalysts may also carry a metal hydrogenation component, preferably Group VIII metals, especially Group VIII noble metals. Hydrodewaxing conditions include temperatures of 280–380° C., pressures of 300–3000 psig, LHSV of 0.1–5.0 $h^{-1}$ and treat gas rates of from 500–5000 scf/bbl.

Hydroprocessing involves at least one reactor having an inlet temperature and pressure and an outlet temperature and pressure, and commonly occurs in multiple zones (or stages) involving sequences such as hydrotreating/hydrocracking, hydrotreating/hydrodewaxing, hydrotreating/hydroisomerization, hydrocracking/hydrodewaxing, hydrocracking/hydrofinishing, hydrodewaxing/hydrofinishing and the like. Typical hydroprocessing configurations include hydrotreating followed by hydrocracking, hydrotreating or hydrocracking followed by hydrofinishing or hydrodewaxing and 2-stage hydrocracking or hydrotreating in which at least two reactors are sequentially staged. Such hydroprocessing schemes typically involve a disengagement step which involves depressurization to remove contaminants, and product and/or intermediates separation. The individual hydroprocessing zones may use a single reactor or may use multiple reactors.

A common practice in the art is to disengage, i.e., depressurize between hydroprocessing steps. The reason for such disengagement is to strip the effluent from the first hydroprocessing step (or zone) before passing the effluent to a second hydroprocessing step. An interstage stripping zone is employed to remove gaseous contaminants created in the first hydroprocessing step such as $H_2S$ and $NH_3$ and may also be used to strip light (low boiling) products from the effluent. Such gaseous contaminants may adversely impact the performance of catalysts in the second hydroprocessing step or zone. However, before passing the stripped effluent to the second hydroprocessing step, it is usually necessary to repressurize and reheat the effluent.

The present process involves a first separation zone following the first hydroprocessing zone, a second hydroprocessing zone and a second separation zone. Unlike the common practice in the art, in the present invention the first and second separation zones are conducted at the pressure of the preceding hydroprocessing zone. There is no disengagement, i.e., depressurization between first and second hydroprocessing zones or following the second hydroprocessing zone and the second separation zone. Further, gases stripped from the second high pressure separation zone are recycled to the first separation zone or recycled to the fresh feed to the first hydroprocessing zone. The different hydroprocessing zones are typically operated at different temperatures. Thus it is preferred to include at least one heat exchanger between hydroprocessing zones or between hydroprocessing zones and separation zones.

High pressure separators are known in the art. They may include flash drums, pressure strippers which include pressure separators for separating liquids and gases at high temperatures or combinations thereof. These units are designed to operate at high temperatures such as the temperature of the preceding hydroprocessing zone. High pressure strippers may operate in either the co-current or countercurrent mode with regard to the stripping gas.

In a preferred embodiment, the first hydroprocessing zone results in the generation of contaminants which might reduce the efficiency of a subsequent hydroprocessing zone or stage. Examples of such sequences include hydrotreating followed by hydrocracking, hydrotreating followed by hydrodewaxing, hydrocracking followed by hydrodewaxing, hydrotreating followed by hydrofinishing, and raffinate hydroconversion followed by hydrodewaxing. Typical contaminants generated in the first hydroprocessing zone include water, ammonia and hydrogen sulfide.

The process is further described with reference to a representative process shown in FIG. 1. Fresh feed, line 8, and hydrogen, line 6, are fed through line 10 to first hydroprocessing zone 12 which is a hydrocracker operating under hydrocracking conditions to produce a hydrocrackate, hydrogen sulfide, ammonia and light hydrocarbon gases. The products from the hydrocracker are passed through line 14 and heat exchanger 16 to a first separation zone 20 which is as flash separator comprising a high pressure separator drum.

Liquid product comprising hydrocrackate is stripped with gas effluent that is passed to separator 20 through line 44. Light hydrocarbons, hydrogen sulfide and ammonia are separated from hydrocrackate and sent through line 22 to further processing. The stripped hydrocrackate is sent through line 24, heat exchangers 26 and 30, and pump 28 to the second hydroprocessing zone 32 which is a hydrodewaxer operating under hydrodewaxing conditions. There is no disengagement (no depressurization) between hydroprocessing zones 20 and 32. For purposes of pressure balance, it is preferred to operate the second hydroprocessing zone at a higher pressure than the first hydroprocessing zone.

The hydrodewaxer removes waxy paraffins from the hydrocrackate by selective hydrocracking, isomerization or some combination thereof. Fresh hydrogen is added to zone 32 through line 34 as needed. The dewaxed product and any gases are removed through line 36 and passed through heat exchanger 38 to separation zone 40. There is no disengagement between zones 32 and 40. The separator that comprises separation zone 40 separates liquid product from gases. The liquid product (the dewaxed product) is passed through line 42 for further processing. The gaseous product from separator 40 is passed through line 44 to separation zone 20 where it is used as a stripping gas for liquids in separator 20. In the alternative, some of the gaseous product from separator 40 may be sent to the feed to hydroprocessing zone 12 through line 48. The relative amounts of flow of gaseous product may be controlled by valves 46 and 50.

In the process described for FIG. 1, most of the hydrogen sulfide and ammonia is removed in separation zone 20 except for the equilibrium concentration dictated by the partial pressures of theses gases in the effluent from the first hydroprocessing zone. By treating with the gaseous product from separator 40, which gaseous product contains very little (if any) hydrogen sulfide or ammonia, the equilibrium concentration of these gases is further reduced. The liquid product that enters hydroprocessing zone 32 thus contains almost no hydrogen sulfide or ammonia. This can be important if the catalyst used in zone 32 is sensitive to these contaminants. The equilibrium is shifted in favor of desorption of any remaining hydrogen sulfide and ammonia in the liquid product from the first hydroprocessing zone. Not only is greater catalyst protection afforded for the second hydroprocessing zone, but higher reaction rates may also occur. By not depressurizing between or after hydroprocessing zones, a considerable expense savings occurs as the need for depressurizing and repressurizing gaseous streams is avoided.

What is claimed is:

1. A continuous process for interstage stripping between two hydroprocessing zones which comprises:

(a) passing a hydrocarbon feedstock to a first hydroprocessing zone and hydroprocessing the feedstock under first hydroprocessing conditions to form a first hydroprocessed product, said first hydroprocessing zone having a first hydroprocessing temperature and pressure;

(b) passing the first hydroprocessed product to a first stripping zone;

(c) stripping the first hydroprocessed product to form a first gaseous and liquid effluent;

(d) passing the liquid effluent from the first stripping zone to a second hydroprocessing zone and hydroprocessing the liquid effluent under second hydroprocessing conditions to form a second hydroprocessed product, said second hydroprocessing zone having a second hydroprocessing temperature and pressure;

(e) passing the second hydroprocessed product to a second stripping zone;

(f) stripping the second hydroprocessed product to form a second gaseous and liquid effluent; and (g) passing at least a portion of the second gaseous effluent to the first stripping zone and contacting said second gaseous effluent with the first liquid effluent, wherein said portion of the second gaseous effluent passed to said first stripping zone is used as a stripping gas in said first stripping zone.

2. A continuous process for interstage stripping between two hydroprocessing zones which comprises:

(a) passing a hydrocarbon feedstock to a first hydroprocessing zone and hydroprocessing the feedstock under first hydroprocessing conditions to form a first hydroprocessed product, said first hydroprocessing zone having a first hydroprocessing temperature and pressure;

(b) passing the first hydroprocessed product to a first stripping zone, said first stripping zone including a flash separator and a pressure stripper;

(c) flashing the first hydroprocessed product to form a first gaseous and liquid effluent;

(d) passing the first liquid effluent from the flash separator to the pressure stripper and stripping the liquid effluent to form a second gaseous and liquid effluent;

(e) passing the second liquid effluent from the first stripping zone to a second hydroprocessing zone and hydroprocessing the liquid effluent under second hydroprocessing conditions to form a second hydroprocessed product, said second hydroprocessing zone having a second hydroprocessing temperature and pressure;

(f) passing the second hydroprocessed product to a second stripping zone;

(g) stripping the second hydroprocessed product to form a third gaseous and liquid effluent; and (h) passing at least a portion of the third gaseous effluent to the first stripping zone and contacting said third gaseous effluent with the first liquid effluent, wherein said portion of the third gaseous effluent passed to said first stripping zone is used as a stripping gas in said first stripping zone.

3. The process of claim 1 wherein a portion of the second gaseous effluent is passed to the first stripping zone and a second portion is passed to the first hydroprocessing zone.

4. The process of claim 2 wherein a portion of the third gaseous effluent is passed to the pressure stripper in the first stripping zone and a second portion is passed to the first hydroprocessing zone.

5. The process of claim 4 wherein the portion of the third gaseous effluent is passed through a heat exchanger to the first hydroprocessing zone.

6. The process of claim 1 wherein there is at least one heat exchanger following the first and second hydroprocessing zones.

7. The process of claim 2 wherein there is at least one heat exchanger following the first and second hydroprocessing zones.

8. The process of claim 1 wherein the first stripping zone includes a flash separator and a pressure stripper.

9. The process of claim 1 wherein the first hydroprocessing zone comprises hydrotreating and the second hydroprocessing zone comprises catalytic dewaxing.

10. The process of claim 2 wherein the first hydroprocessing zone comprises hydrotreating and the second hydroprocessing zone comprises catalytic dewaxing.

11. The process of claim 1 wherein the first hydroprocessing zone comprises hydrocracking and the second hydroprocessing comprises catalytic dewaxing.

12. The process of claim 2 wherein the first hydroprocessing zone comprises hydrocracking and the second hydroprocessing comprises catalytic dewaxing.

13. The process of claim 1 wherein the first hydroprocessing zone comprises hydrotreating and the second hydroprocessing comprises hydrocracking.

14. The process of claim 2 wherein the first hydroprocessing zone comprises hydrotreating and the second hydroprocessing comprises hydrocracking.

15. The process of claim 1 wherein the first hydroprocessing zone comprises hydrotreating or hydrocracking and the second hydroprocessing comprises hydrofinishing.

16. The process of claim 2 wherein the first hydroprocessing zone comprises hydrotreating or hydrocracking and the second hydroprocessing comprises hydrofinishing.

* * * * *